US009994036B2

(12) United States Patent
Angulo Navarro et al.

(10) Patent No.: US 9,994,036 B2
(45) Date of Patent: Jun. 12, 2018

(54) SENSOR ASSEMBLIES TO IDENTIFY INK LEVELS

(71) Applicant: HEWLETT-PACKARD DEVELOPMENT COMPANY, Houston, TX (US)

(72) Inventors: Emilio Angulo Navarro, Barcelona (ES); Fernando Bayona Alcolea, Sant Cugat del Valles (ES); Jorge Castano Aspas, Barcelona (ES); Mikel Zuza Irurueta, Barcelona (ES); Alfonso Cameno Salinas, Barcelona (ES); Albert Crespi Serrano, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days. days.

(21) Appl. No.: 15/115,719

(22) PCT Filed: Feb. 4, 2014

(86) PCT No.: PCT/US2014/014564

§ 371 (c)(1),
(2) Date: Aug. 1, 2016

(87) PCT Pub. No.: WO2015/119594

PCT Pub. Date: Aug. 13, 2015

(65) Prior Publication Data

US 2017/0008297 A1 Jan. 12, 2017

(51) Int. Cl.

| | |
|---|---|
| ***B41J 2/165*** | (2006.01) |
| ***B41J 2/175*** | (2006.01) |
| ***B41J 29/393*** | (2006.01) |

(52) U.S. Cl.

CPC ..... *B41J 2/17566* (2013.01); *B41J 2/175* (2013.01); *B41J 2/17513* (2013.01);
(Continued)

(58) Field of Classification Search

None

See application file for complete search history.

(56) References Cited

U.S. PATENT DOCUMENTS 5,132,500 A * 7/1992 Clew ..... H01H 35/34 200/83 P
5,657,057 A * 8/1997 Nakajima ..... B41J 2/17566 347/14

(Continued)

FOREIGN PATENT DOCUMENTS

CN 1259088 A 7/2000
CN 1833870 A 9/2006

(Continued)

OTHER PUBLICATIONS

Virgili, Magnus. Automatic Ink Viscosity and Bucket Content Measurement for Printing Presses. 2013.

(Continued)

*Primary Examiner* — Alejandro Valencia
(74) *Attorney, Agent, or Firm* — HP Inc. Patent Department

(57) ABSTRACT

An example in accordance with an aspect of the present disclosure includes an ink channel of a printer, coupleable to an ink supply to receive an ink. A sensor assembly is mounted to the ink channel, including a sensor in fluid communication with the ink channel to identify an ink level of the ink supply based on a pressure difference between an air pressure, associated with the sensor assembly, and an ink pressure, associated with the ink channel.

15 Claims, 8 Drawing Sheets

(52) U.S. Cl.
CPC .... *B41J 29/393* (2013.01); *B41J 2002/17576* (2013.01); *B41J 2002/17579* (2013.01)

(56) References Cited

U.S. PATENT DOCUMENTS

| | | | | |
|---|---|---|---|---|
| 5,788,388 | A | 8/1998 | Cowger et al. | |
| 6,412,894 | B1 | 7/2002 | Askren et al. | |
| 6,811,249 | B2 | 11/2004 | DeVries et al. | |
| 6,988,793 | B2 | 1/2006 | Wilson et al. | |
| 7,455,395 | B2 * | 11/2008 | Wilson | B41J 2/17509 347/85 |
| 2002/0012016 | A1 | 1/2002 | Wilson et al. | |
| 2002/0145650 | A1 | 10/2002 | Pan et al. | |
| 2005/0046681 | A1 * | 3/2005 | Kumagai | B41J 2/17556 347/85 |
| 2007/0115307 | A1 | 5/2007 | Smith | |
| 2009/0027435 | A1 | 1/2009 | Katada | |
| 2009/0071258 | A1 * | 3/2009 | Kouda | A61M 1/3641 73/723 |
| 2009/0219323 | A1 | 9/2009 | Silverbrook et al. | |
| 2010/0026741 | A1 * | 2/2010 | Gold | B41J 2/17566 347/7 |
| 2011/0181638 | A1 | 7/2011 | Kim et al. | |
| 2012/0001989 | A1 | 1/2012 | Silverbrook | |
| 2012/0154486 | A1 * | 6/2012 | Anderson | B41J 2/155 347/40 |

FOREIGN PATENT DOCUMENTS

| | | | |
|---|---|---|---|
| CN | 101421602 | A | 4/2009 |
| EP | 1203666 | A1 | 5/2002 |
| WO | WO-2002081225 | | 10/2002 |
| WO | WO-2010077387 | | 7/2010 |

OTHER PUBLICATIONS

Korean Intellectual Property Office, International Search Report and Written Opinion for PCT/US2014/014564 dated Nov. 25, 2014 (12 pages).

* cited by examiner

SENSOR ASSEMBLIES TO IDENTIFY INK LEVELS

BACKGROUND

A printer may use an ink cartridge to print. An ink cartridge may have an embedded sensor to determine ink supply levels. The ink cartridge may be disposable and replaceable, along with the embedded sensor, when the ink cartridge is empty.

BRIEF DESCRIPTION OF THE DRAWINGS/FIGURES

DETAILED DESCRIPTION

In examples described herein, a sensor assembly for a printer may include a sensor to detect ink supply levels, e.g., including a pressure sensor in an ink channel of the printer. Accordingly, an ink cartridge does not need to include an embedded sensor, thereby reducing a cost of the ink cartridge. In an example, a printer may include a sensor for each of multiple ink supplies (or other printing fluids). Accordingly, costs over the life of the printer will be reduced significantly, due to cost reduction of each consumable ink cartridge by omitting an embedded sensor to determine ink levels. Removing the sensor from the ink cartridge, and including it in the printer, may save considerable costs and reduce a carbon footprint for printer usage, throughout the use of hundreds of ink cartridges during a printer's service life.

Figure 1:
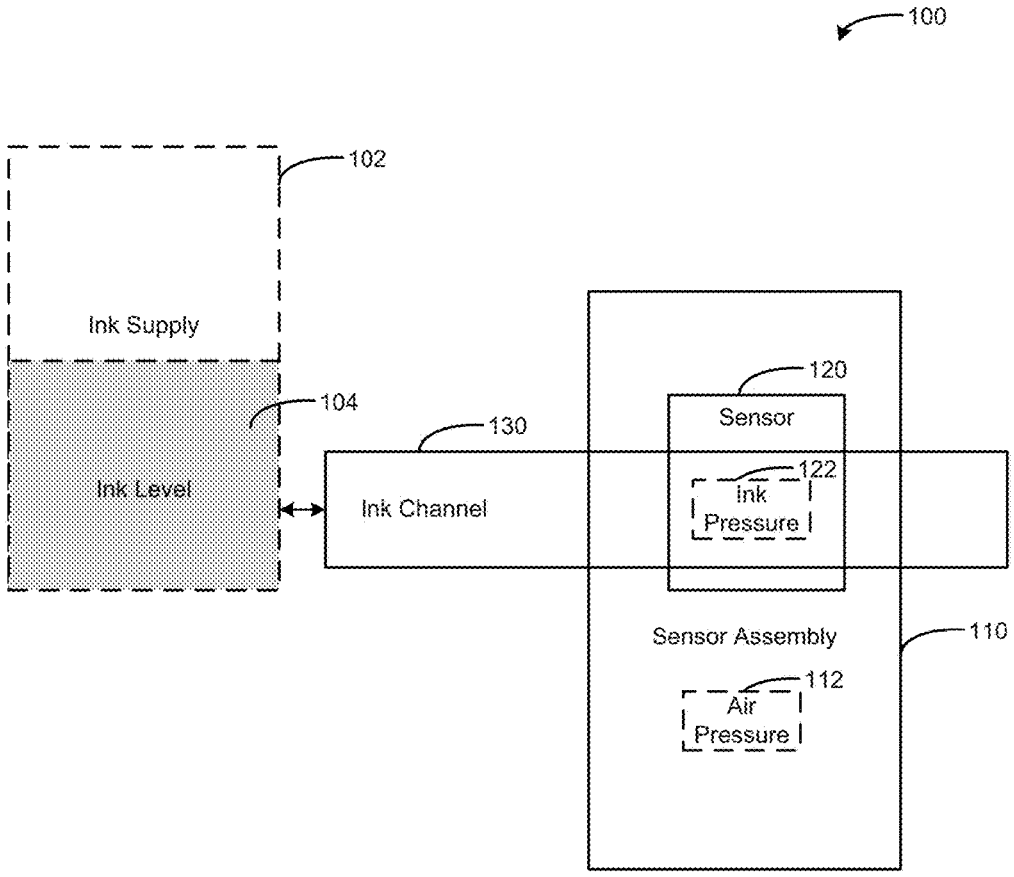
FIG. 1 is a block diagram of a system including an ink channel and a sensor assembly according to an example.

FIG. 1 is a block diagram of a system 100 including an ink channel 130 and a sensor assembly 110 according to an example. The sensor assembly 110 is coupled to the ink channel 130. The ink channel 130 is coupleable to an ink supply 102. The sensor assembly 110 includes a sensor 120 to identify an ink pressure 122 and air pressure 112. The ink level 104 of the ink supply 102 is identified based on the ink pressure 122 and the air pressure 112.

The sensor 120 may be used to precisely identify an amount of ink remaining in the ink cartridges (e.g., an ink level 104), including when reaching an out-of-ink condition. The sensor 120 may communicate the out-of-ink condition to a printer controller/processor, allowing the printer controller to provide a notification and/or halt the printer when one or more of the ink cartridges reaches out-of-ink status (e.g., to avoid damage to the print head). The sensor 120 may be an affordable type of sensor, similar to embeddable sensors of other ink cartridges, resulting in cost advantages compared to more expensive external-specific sensors. The sensor 120 may identify the ink pressure 122 associated with the ink channel 130.

The sensor assembly 110, including the sensor 120, may be sealed to the ink channel 130. In an example, a housing for the sensor assembly (e.g., a pressure box) may include a groove to receive an O-ring to provide the seal between the sensor assembly 110 and the ink channel 130. In alternate examples, the sensor assembly 110 may be sealed to the ink channel 130 using other seals, such as glue, epoxy, welding, pressure-fit, and so on. The ink channel 130 may be removable, to allow interchangeability of the ink channel 130 and/or the sensor assembly 110 and its various components. The relative positions and sizes of the illustrated components are not shown to scale, and the sensor 120 and sensor assembly 110 may be positioned near the ink supply 102, to reduce potential pressure losses between the ink supply 102 and the sensor 120 along the ink channel 130. The ink channel 103 is coupleable to the ink supply 102 based on a fluid seal. In an example, the ink channel 130 may include a needle to penetrate the ink supply 102 and enable inflow of ink to the sensor 120 via the ink channel 130.

The sensor assembly 110 also may identify an air pressure 112, such as a static air pressure associated with the sensor assembly 110. In an example, the sensor assembly 110 may include a sealed pressure box to expose a portion of the sensor 120 to the air pressure 112, thereby enabling the sensor 120 to identify both the ink pressure 122 and the air pressure 112. In an alternate example, system 100 may include an air channel to communicate the air pressure 112 to the sensor assembly 110.

System 100 may determine the ink level 104 according to a difference in pressure between the air pressure 112 and the ink pressure 122. For example, the system 100 may determine that the ink level 104 is full, based on the ink pressure 122 being approximately equal to the air pressure 112. As ink is consumed, the ink level 104 drops, reducing the ink pressure 122 and causing a pressure differential between the ink pressure 122 and the air pressure 112. When the ink supply 102 is empty due to a low ink level 104, the differential between the ink pressure 122 and the air pressure 112 will be greatest. In an example, the pressure differential between the ink pressure 122 and the air pressure 112 may correspond to an ink level 104 according to a linear phase and an exponential phase. Initially, in the linear phase, the pressure differential may begin at approximately zero, corresponding to a full ink supply 102 where air pressure 112 is approximately equal to ink pressure 122. As ink is consumed during the linear phase, the pressure differential may change linearly toward approximately 0.10 pounds per square inch (psi), corresponding to a loss of approximately 75% of the ink supply 102, resulting in reduction of the ink pressure 122 associated with the remaining 25% of ink. As the ink level 104 continues to drop, the pressure differential may increase exponentially, from approximately 0.10 psi at 25% ink remaining, to 1.00 psi at 0% ink remaining (1.00 psi=empty). For example, when the ink level 104 reaches 12.5% ink remaining, the pressure differential may increase a further 0.10 psi along an exponential curve. Consumption of the final, remaining 12.5% of the ink supply may correspond to a further 0.80 change in the pressure differential, from 0.20 psi to 1.00 psi, along the exponential curve. Accordingly, the system 100 may determine that the ink supply 102 has been exhausted when the pressure differential has reached 1.00 psi. In alternate examples, the specific psi and ink supply percentage values may be varied according to particular features of the ink channel 130, sensor 120, sensor assembly 110, ink supply 102, and so on. Thus, the sensor 120 may be used to measure ink flow, and ink flow may be used to diagnose whether the sensor 120 is working properly.

Figure 2:
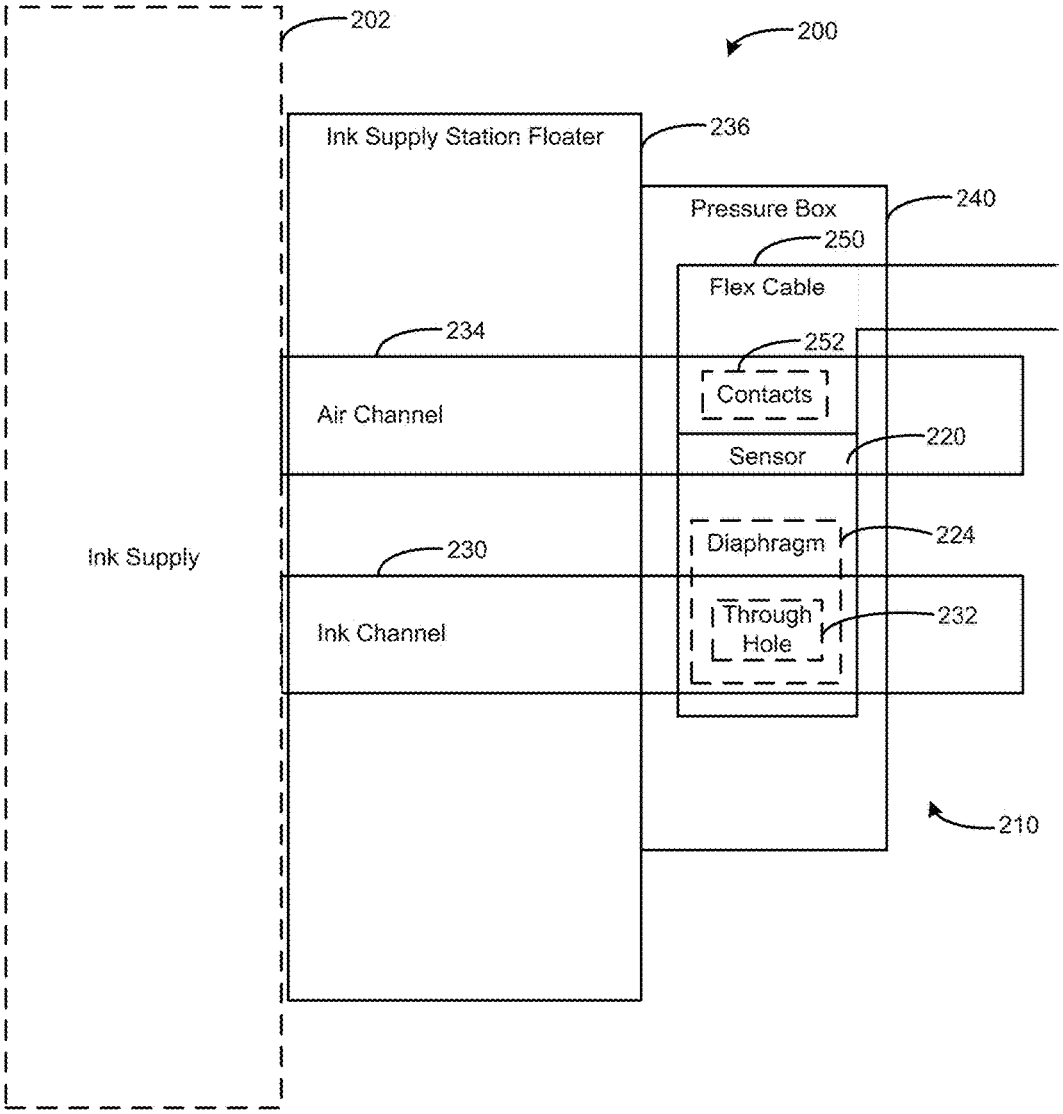
FIG. 2 is a block diagram of a system including an ink channel and a sensor assembly according to an example.

FIG. 2 is a block diagram of a system 200 including an ink channel 230 and a sensor assembly 210 according to an example. The sensor assembly 210 is coupled to the ink channel 230 and an air channel 234. The ink channel 230 and air channel 234 are coupleable to an ink supply 202. The sensor assembly 210 is coupled to an ink supply station floater 236, and includes a pressure box 240 to contain a sensor 220 and contacts 252. The sensor 220 is based on a diaphragm 224 exposed to a through hole 232 of the ink channel 230. The sensor 220 is coupled to a flex cable 250 that includes contacts 252.

The floater 236 is to connect the ink channel 230 and air channel 234 between the ink supply 202 and the printer. The floater 236 may mount the sensor assembly 210 and provide alignment between the sensor assembly 210 and the ink supply 202, ensuring a reliable connection between ink and printer. The floater 236 may enable a tolerance of movement between the ink supply 202 and the sensor assembly 210 (e.g., enable spring-loaded movement of the sensor assembly 210 relative to the ink supply 202).

The sensor assembly 210 may include a pressure box 240. The pressure box 240 is to interface with the ink channel 230 and the air channel 234. The pressure box 240 is to contain the sensor 220, enabling the sensor 220 to measure the pressure difference between the static air pressure associated with the air channel 234 (e.g., which is to pressurize the air inside the pressure box 240) and the ink pressure associated with the ink channel 230 (e.g., via through hole 232).

The sensor 220 may include a diaphragm 224 for identifying pressures. The diaphragm 224 may be exposed to air on one side of the diaphragm 224, and ink on the other side of the diaphragm 224. In an example, the sensor 220 may be exposed to the ink pressure via through hole 232 in fluid communication with the ink channel 230. The ink pressure may actuate the diaphragm 224. The sensor 220 also may be exposed to the air pressure of the air channel 234 based on exposure to an inside of the pressurized pressure box 240, to monitor the air pressure. Further, the sensor 220 may include contacts 252 to monitor for other conditions, such as conditions indicative of a broken bag in the ink supply 202.

The sensor assembly 210 may include various seals between components. For example, the pressure box 240 may include a removable cover and a first seal, to seal the cover to the pressure box 240 to pressurize the pressure box 240 and avoid air leakage. The pressure box 240 may be sealed to the ink channel 230 based on a second seal to isolate the ink of the ink channel 230 within the sensor 220 and prevent ink leakage (e.g., into the pressure box 240 and/or onto the printer). Seals may be provided based on various techniques. In an example, a seal may be provided as an O-ring. In alternate examples, a seal may be provided as ultrasound welding between components, epoxy gluing, chemical sealing, or other techniques to establish seals against leakage.

The ink channel 230 and the air channel 234 may be provided as two channels that are isolated from each other. The channels may be formed as extensions of the pressure box 240, such that channels are integrated with the pressure box 240 as a single unit, while maintaining fluid isolation from each other (i.e., to prevent air exposure to the portion of sensor 220 that is intended to determine ink pressure, and to prevent air from infiltrating the ink channel 230). The air channel 234 may be extended by, and/or formed as, a silicone tube or other suitable material to establish a connection with the floater 236 and/or the ink supply 202.

The sensor assembly 210 may include a cable 250. The cable 250 is shown as a flex cable in FIG. 2, but may be other types of cables in alternate examples. The cable 250 is to support various components and associated electrical traces of the sensor assembly 210. The cable 250 is to be routed into and out of the pressure box 240, while enabling the pressure box 240 to remain sealed without causing leakage. Accordingly, the pressure box 240 may include a seal at the flex cable 250. In an example, an O-ring seal for a cover of the pressure box 240 also may provide a seal against the flex cable 250.

The sensor 220 may be mounted to a base, such as a ceramic mount to which the sensor 220 is attached. The cable 250 may interface with the sensor 220 and/or the ceramic base, e.g., based on wire bonding. Wire bonding may be used to attach and/or support various components, to provide electrical communication between components. In an example, the contacts 252 and diaphragm 224 may interface with the cable 250 based on wire bonds.

The cable 250 may include a trace that is dedicated to contacts 252, arranged in the air channel 234 and used to detect a broken bag of ink supply 202. The contacts 252 may be arranged in the holes connecting an interior of the pressure box 240 with the air channel 234. The contacts 252 of the cable 250 may cross the air channel 234, e.g., along a diameter across a cross-section of the air channel 234. The contacts 252 thus may serve as a broken bag sensor. If the ink supply 202 is broken, ink may intrude into the air channel 234, arriving at the pressure box 240. The contacts 252 may detect the presence of an ink drop, identifying that there is a broken bag in the ink supply 202. Accordingly, printing may be halted (e.g., based on a printer controller/processor communicating with contacts 252) in response to the identification of the broken ink supply 202, avoiding damage to the printer.

The cable 250 may include a plurality of cables, and can support other components such as electromagnetic interference (EMI) suppressors, filters, or other digital components. Encapsulant, such as a plastic-like gel or sealant, may be used as a wire bond protective cover, to protect wire bonds between components and to mechanically support the wires and bonds (e.g., bond balls formed at the bond between wires and the components to which the wires are bonded). The encapsulant may help the sensor 220 endure against wear and/or corrosion, over years associated with the lifetime use of the printer.

The cable 250 (e.g., a flex cable) may interface with and/or include a connector, to connect electrical signals between the flex cable 250 and a printer. In an example, a connector may be used to couple an external braided wire cable from the printer to the flex cable 250, which in turn may communicate with associated components of the sensor assembly 210. The connector may be mounted to an external surface of the sensor assembly 210, to provide mechanical support and isolation to avoid damage to the flex cable. In an example, the connector may be mounted to a removable cover of the pressure box 240, such that the flex cable length provides slack to enable the cover to be opened and closed without disconnecting the flex cable 250.

Figure 3:
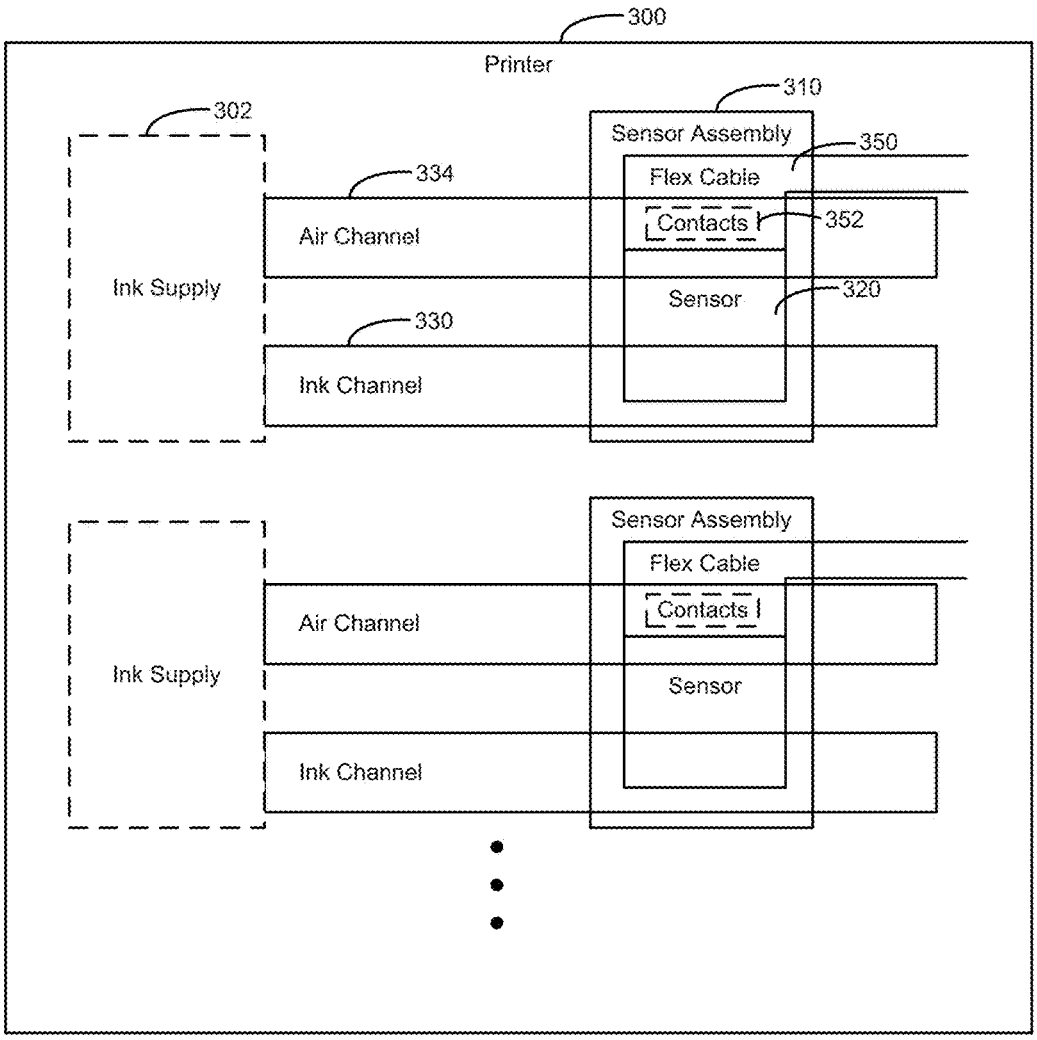
FIG. 3 is a block diagram of a printer including a plurality of ink channels and corresponding sensor assemblies according to an example.

FIG. 3 is a block diagram of a printer 300 including a plurality of ink channels 330 and corresponding sensor assemblies 310 according to an example. An ink channel 330 and air channel 334 associated with a sensor assembly 310 are coupleable to an associated ink supply 302, such that the printer 300 may print using a plurality of ink supplies 302

(e.g., different colored inks). The sensor assembly 310 may communicate with the printer 300 via the flex cable 350. The sensor assembly 310 may include contacts 352, which may be associated with the flex cable 350 and/or the sensor 320.

In an example, the printer 300 may be a high-volume, 2-inch platform inkjet printer, to interface with an ink supply 302 including an ink bag and cartridge chassis having an acumen chip for communication external to the ink supply 302.

Figure 4:
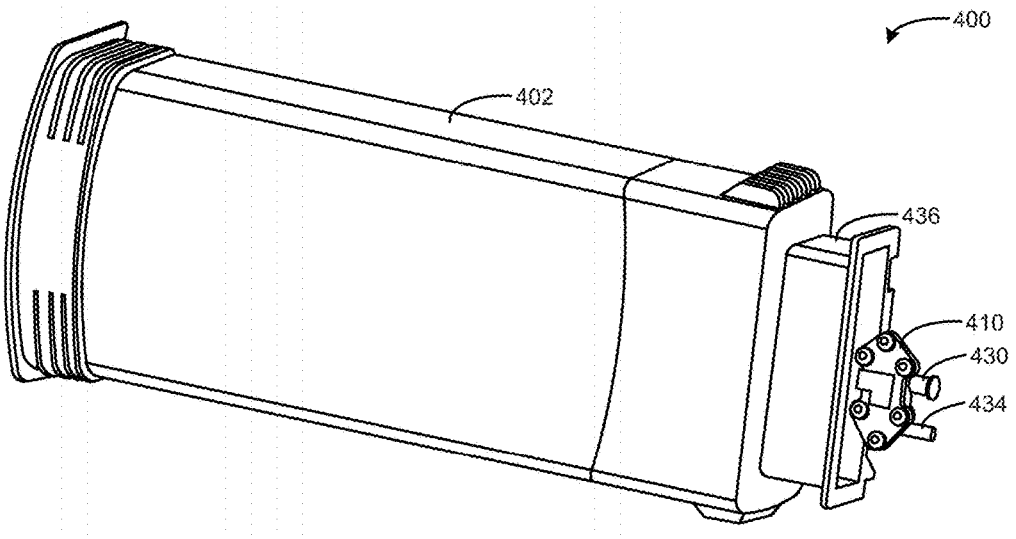
FIG. 4 is a block diagram of a system including an ink supply and a sensor assembly according to an example.

FIG. 4 is a block diagram of a system 400 including an ink supply 402 and a sensor assembly 410 according to an example. The sensor assembly 410 is coupleable to the ink supply 402 via the ink supply station floater 436. The sensor assembly 410 includes an ink channel 430 and air channel 434 coupleable to the ink supply 402.

The sensor assembly 410 may be coupled to the floater 436 via the ink channel 430 and the air channel 434. In an example, the sensor assembly 410 may be coupled to the floater 436 based on a snap-together assembly. The ink supply 402 may be mated to the floater 436, to enable fluid communication between the ink supply 402 and the ink channel and/or air channel.

Figure 5:
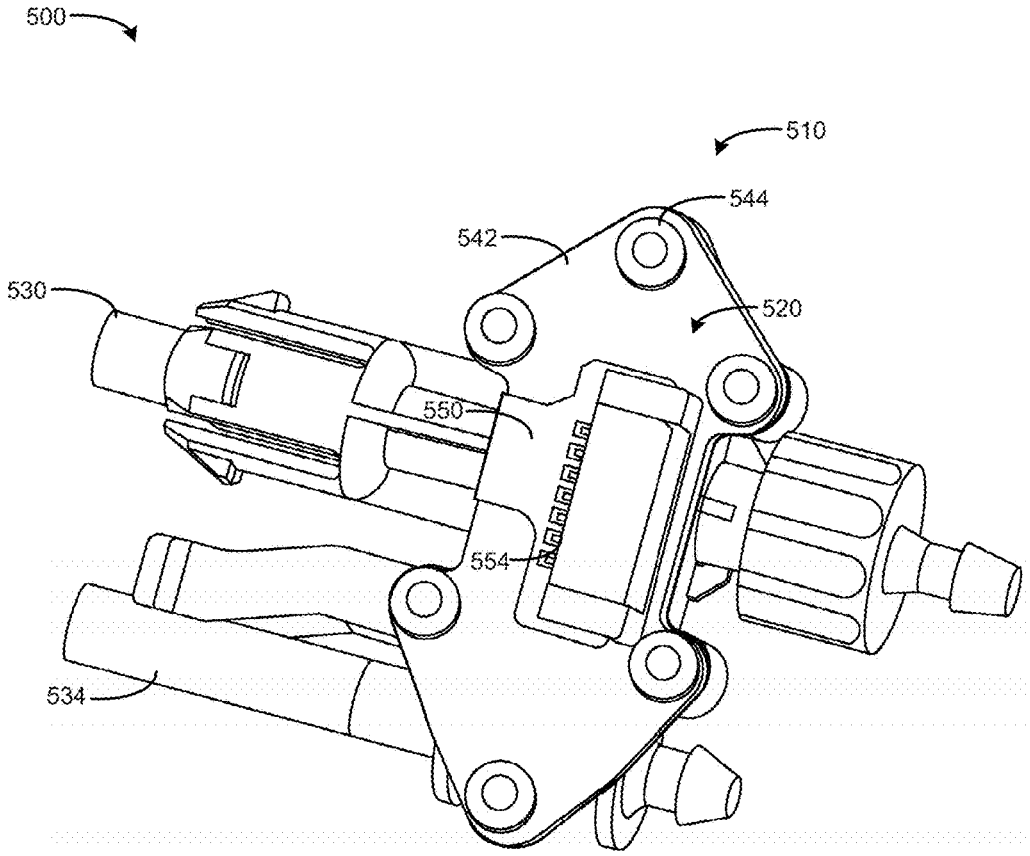
FIG. 5 is a block diagram of a system including an ink channel and a sensor assembly according to an example.

FIG. 5 is a block diagram of a system 500 including an ink channel 530 and a sensor assembly 510 according to an example. The sensor assembly 510 is shown having a cover 542 in place, secured by fasteners 544, to seal the sensor 520 (concealed under the cover 542) in the sensor assembly 510. The sensor assembly 510 is coupled to the ink channel 530 and the air channel 534. A connector 554 is coupled to the end of the flex cable 550, and the connector 554 is mounted to the cover 542.

The cover 542 is to cover and seal the sensor 520 inside the pressure box of the sensor assembly 510. The cover 542 also may support connector 544 mounted to the external surface of the cover 542 (e.g., a connector 544 mounted to the end of the flex cable 550 extending from the sealed pressure box, for communicating with the sensor 520 and other components within the sensor assembly 510). The pressure box cover 542 is shown attached to the pressure box using fasteners 544, such as screws or other fasteners, or other techniques such as snap-together, gluing, welding, and the like. The cover 542 may use a seal, such as an O-ring or other technique, to ensure that the cover 542 is sealed to the pressure box to avoid leakage infiltrating between the pressure box and cover 542.

Figure 6:
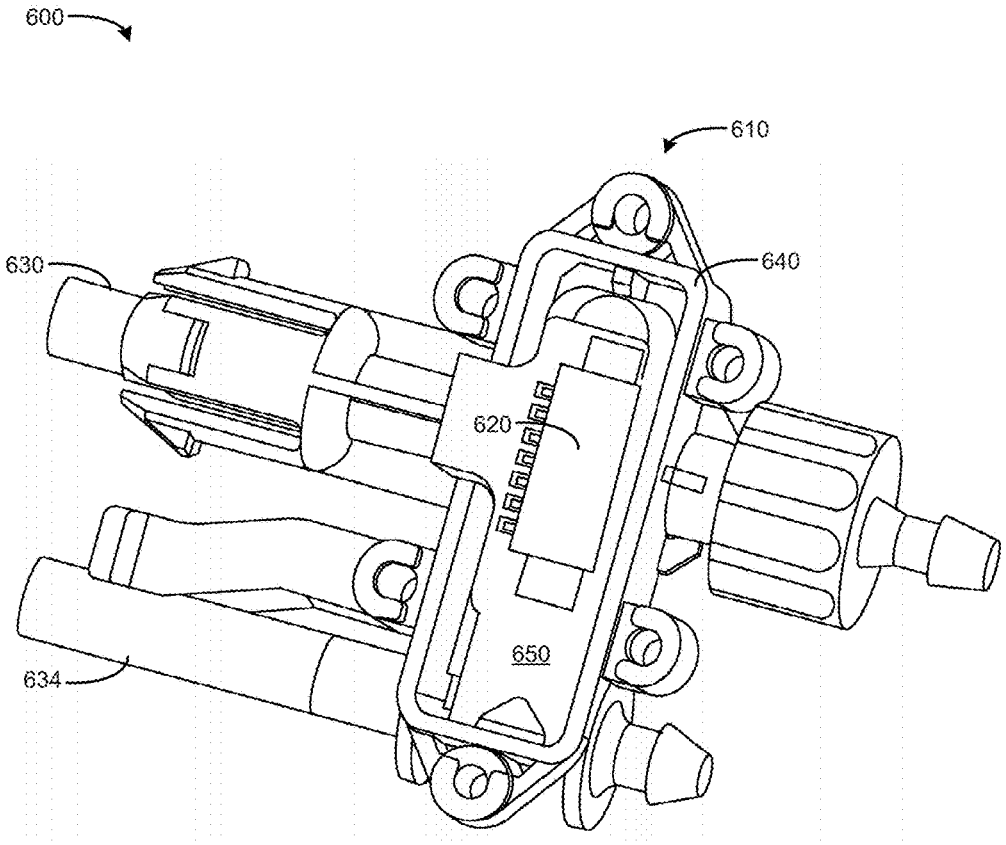
FIG. 6 is a block diagram of a system including an ink channel and a sensor assembly according to an example.

FIG. 6 is a block diagram of a system 600 including an ink channel 630 and a sensor assembly 610 according to an example. The sensor assembly 610 is shown without a cover, to reveal features within the pressure box 640, including the sensor 620. The pressure box 640 is coupled to the ink channel 630 and the air channel 634. The sensor 620 is coupled to the flex cable 650.

The pressure box 640 may extend across both the ink channel 630 and the air channel 634, enabling sensor 620 (and associated flex cable 650/contacts) to interact with the ink channel 630 and the air channel 634. For example, the sensor 620 may be sealed against a through-hole communicating with the ink channel 630, to identify ink pressure and prevent ink from flowing past the sensor 620 into the pressure box 640. The pressure box 640 may include features to accommodate a seal with the cover (not shown in FIG. 6), such as a groove running along the edge of the pressure box 640 to receive an O-ring within the groove.

Figure 7:
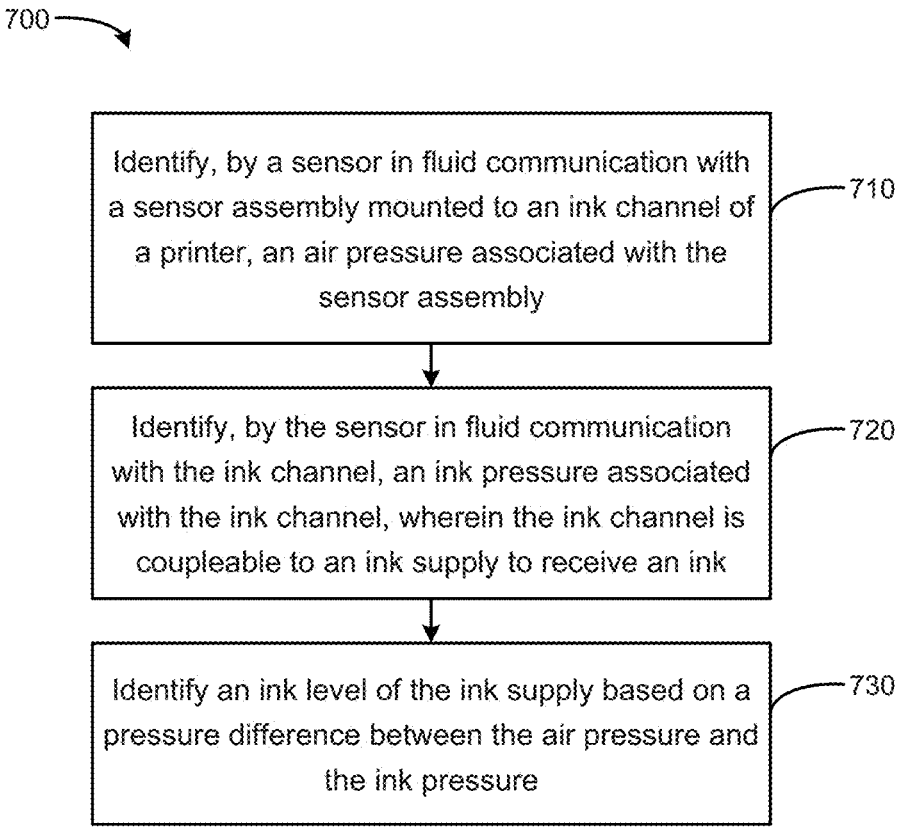
FIG. 7 is a flow chart based on identifying an ink level of an ink supply according to an example.
Figure 8:
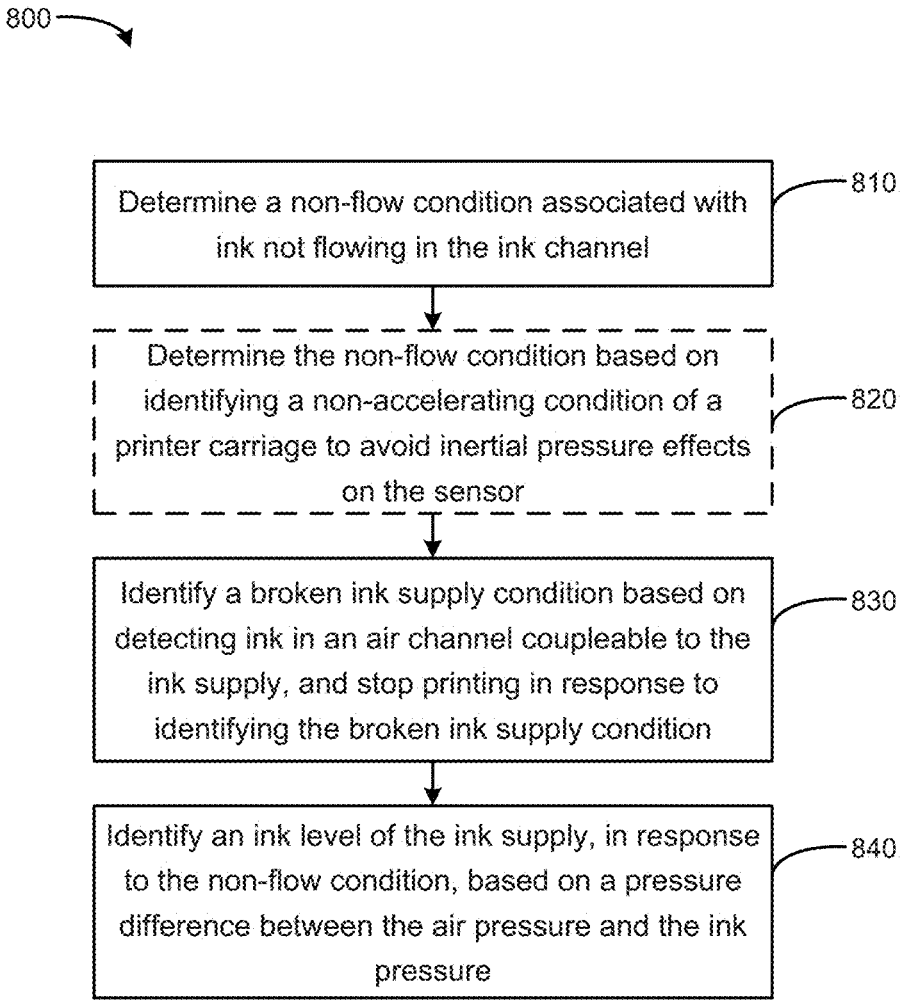
FIG. 8 is a flow chart based on identifying an ink level of an ink supply according to an example.

Referring to FIGS. 7 and 8, flow diagrams are illustrated in accordance with various examples of the present disclosure. The flow diagrams represent processes that may be utilized in conjunction with various systems and devices as discussed with reference to the preceding figures. While illustrated in a particular order, the disclosure is not intended to be so limited. Rather, it is expressly contemplated that various processes may occur in different orders and/or simultaneously with other processes than those illustrated.

FIG. 7 is a flow chart 700 based on identifying an ink level of an ink supply according to an example. In block 710, a sensor, in fluid communication with a sensor assembly mounted to an ink channel of a printer, is to identify an air pressure associated with the sensor assembly. In an example, the sensor is to identify a static air pressure within a pressure box, based on an air channel in fluid communication with the pressure box. In block 720, the sensor, in fluid communication with the ink channel, is to identify an ink pressure associated with the ink channel. The ink channel is coupleable to an ink supply to receive an ink. In an example, the ink channel includes a through hole to establish fluid communication with a portion of the pressure box that is sealed against the sensor to isolate the ink from the static air pressure in the pressure box. In block 730, an ink level of the ink supply is identified, based on a pressure difference between the air pressure and the ink pressure. In an example, the ink level is identified based on a pressure differential between the air pressure and the ink pressure, where the ink remaining is determined according to a linear phase and an exponential phase of the change in the pressure differential.

FIG. 8 is a flow chart based on identifying an ink level of an ink supply according to an example. In block 810, a non-flow condition is determined, associated with ink not flowing in the ink channel. In an example, a printer may use a processor, controller, and/or firmware to identify when there is no ink flow in the ink color that is to be measured, according to conditions of the printer (e.g., whether a signal is being sent to the print head for that color of ink). In block 820, the non-flow condition is determined, based on identifying a non-accelerating condition of a printer carriage to avoid inertial pressure effects on the sensor. For example, a printer controller may identify that the voltage applied to a carriage motor of the printer is unchanging over a time period, including a condition where no voltage is applied. Block 820 refers to acceleration of a printer carriage in an example, and may not apply to other printers, e.g., printers that do not have a carriage or otherwise do not subject elements to acceleration. Accordingly, block 820 may be varied and/or omitted, and non-flow conditions may be determined based on alternate techniques, such as by identifying trends or other conditions regarding pressure variations over time. In block 830, a broken ink supply condition is identified, based on detecting ink in an air channel coupleable to the ink supply. Printing may be stopped in response to identifying the broken ink supply condition. In an example, the printer controller may identify that contacts associated with a flex cable coupled to a sensor in the sensor assembly are exposed to ink from an air channel, based on a change in electrical properties across the contacts. In block 840, an ink level of the ink supply is identified, in response to the non-flow condition, based on a pressure difference between the air pressure and the ink pressure. For example, the printer controller may enable identification of the ink level during times when a non-flow condition is established, and prevent identification of the ink level during times when ink is flowing (e.g., during times when ink flow might modify an ink pressure signal due to pressure losses in a floater needle).

Accordingly, examples provided herein may take measurements without a need to interrupt printing, taking pressure measurements as the opportunities arise during a high-volume print run. For example, when there is no ink flow in the ink color that is going to be measured (to avoid pressure loses along the needle), when the printer carriage is not accelerating from left to right or in the middle of a printing zone (to avoid inertial pressure effects on the sensor), and when the air pumps are not pressurizing (to avoid the influence of pressure noise).

Examples provided herein (e.g., methods) may be implemented in hardware, software, or a combination of both. Example systems (e.g., printers) can include a controller/processor and memory resources for executing instructions stored in a tangible non-transitory medium (e.g., volatile memory, non-volatile memory, and/or computer readable media). Non-transitory computer-readable medium can be tangible and have computer-readable instructions stored thereon that are executable by a processor to implement examples according to the present disclosure.

An example system can include and/or receive a tangible non-transitory computer-readable medium storing a set of computer-readable instructions (e.g., software). As used herein, the controller/processor can include one or a plurality of processors such as in a parallel processing system. The memory can include memory addressable by the processor for execution of computer readable instructions. The computer readable medium can include volatile and/or non-volatile memory such as a random access memory ("RAM"), magnetic memory such as a hard disk, floppy disk, and/or tape memory, a solid state drive ("SSD"), flash memory, phase change memory, and so on.

What is claimed is:

1. A printer comprising:

an air channel;

an ink channel coupleable to an ink supply to receive an ink;

a sensor assembly mounted to the ink channel, the sensor assembly including a pressure box to enclose a sensor in fluid communication with the ink channel, wherein the sensor is further in fluid communication with the air channel; and a processor to:

determine a non-flow condition associated with ink not flowing in the ink channel, and in response to the non-flow condition, identify a pressure difference between an air pressure of the air channel measured by the sensor, and an ink pressure of the ink channel measured by the sensor, wherein the determining of the non-flow condition is based on identifying a non-accelerating condition of a printer carriage, the non-accelerating condition identified by detecting that a voltage applied to a carriage motor of the printer is unchanging over a time period;

identify an ink level of the ink supply based on the pressure difference; and identify a broken ink supply condition of the ink supply based on detecting, by the sensor, intrusion of ink into the air channel from the ink supply.

2. The printer of claim 1, comprising a plurality of ink channels corresponding to a plurality of ink supplies for multi-color printing, and a plurality of sensor assemblies corresponding to the plurality of ink channels, wherein the printer is to identify a plurality of ink levels corresponding to the plurality of ink supplies.

3. The printer of claim 1, wherein the printer is to stop printing in response to identifying the broken ink supply condition.

4. The printer of claim 1, wherein the sensor comprises a contact to detect the intrusion of ink into the air channel.

5. A method comprising:

identifying, by a sensor of a sensor assembly mounted to an ink channel of a printer, an air pressure associated with an air channel, the sensor in fluid communication with the air channel;

identifying, by the sensor in fluid communication with the ink channel, an ink pressure associated with the ink channel, wherein the ink channel is coupleable to an ink supply to receive an ink;

determining a non-flow condition associated with ink not flowing in the ink channel, and identifying a pressure difference between the air pressure and the ink pressure in response to the non-flow condition, wherein determining the non-flow condition is based on identifying a non-accelerating condition of a printer carriage to avoid inertial pressure effects on the sensor, the non-accelerating condition identified by detecting that a voltage applied to a carriage motor of the printer is unchanging over a time period;

identifying an ink level of the ink supply based on the pressure difference;

identifying a broken ink supply condition based on detecting, by the sensor, that ink has intruded into the air channel from the ink supply; and stopping printing in response to identifying the broken ink supply condition.

6. A system comprising:

an ink channel, coupleable to an ink supply for a printer, to receive an ink;

a sensor assembly mounted to the ink channel, the sensor assembly including a sensor in fluid communication with the ink channel and in fluid communication with an air channel, the sensor to measure an air pressure of the air channel, and an ink pressure of the ink channel;

an ink supply station floater that supports the sensor assembly coupled to the ink channel and the air channel, the ink supply station floater to provide alignment between the sensor assembly and the ink supply, and enable a tolerance of movement between the ink supply and the sensor assembly; and a processor to:

determine a non-flow condition associated with ink not flowing in the ink channel, and identify a pressure difference between the air pressure and the ink pressure in response to the non-flow condition, wherein the determining of the non-flow condition is based on identifying a non-accelerating condition of a printer carriage, the non-accelerating condition identified by detecting that a voltage applied to a carriage motor of the printer is unchanging over a time period;

identify an ink level of the ink supply based on the pressure difference; and determine that the ink supply has been exhausted based on the ink level.

7. The system of claim 6, wherein the sensor assembly includes a pressure box providing the air pressure that is exposed to the sensor.

8. The system of claim 7, wherein the pressure box is in fluid communication with the ink channel via a through hole to expose the sensor to the ink pressure.

9. The system of claim 8, wherein the pressure box includes a cover sealed by a first seal between the cover and the pressure box, and the pressure box is sealed by a second seal between the pressure box and the ink channel.

10. The system of claim 8, wherein the sensor includes a diaphragm having an air side exposed to the air pressure and an ink side exposed to the ink pressure through the through hole.

11. The system of claim 6, wherein the processor is to identify a broken ink supply based on detecting, by the sensor assembly, intrusion of ink into the air channel from the ink supply.

12. The system of claim 11, wherein the sensor assembly includes a flex cable having contacts to detect the intrusion of ink into the air channel.

13. The system of claim 6, wherein the sensor assembly includes:

a flex cable to transmit signals between the sensor and the printer while maintaining a fluid seal at the sensor assembly, a ceramic base to mount the sensor, and an encapsulant to protect wire bonds associated with the sensor and the flex cable.

14. The system of claim 6, comprising the printer that includes the ink channel, the air channel, and the sensor assembly.

15. The system of claim 7, wherein the ink channel and the air channel are extensions of the pressure box.

* * * * *